US006974494B1

(12) United States Patent
Zahedi

(10) Patent No.: US 6,974,494 B1
(45) Date of Patent: Dec. 13, 2005

(54) APPARATUS AND METHOD USING AN ELECTRIFIED FILTER BED FOR REMOVAL OF POLLUTANTS FROM A FLUE GAS STREAM

(76) Inventor: Karim Zahedi, c/o EFB Inc., P.O. Box 146, Newton Center, MA (US) 02459

( * ) Notice: Subject to any disclaimer, the term of this patent is extended or adjusted under 35 U.S.C. 154(b) by 0 days.

(21) Appl. No.: 10/971,009

(22) Filed: Oct. 25, 2004

(51) Int. Cl.[7] ..... B03C 3/014
(52) U.S. Cl. ..... 95/73; 96/74
(58) Field of Search ..... 95/60, 67, 72, 95/73; 96/52, 68, 74

(56) References Cited

U.S. PATENT DOCUMENTS

| | | | | | |
|---|---|---|---|---|---|
| 1,130,214 | A | * | 3/1915 | Steere | 95/73 |
| 2,209,798 | A | * | 9/1940 | Subkow | 208/350 |
| 2,696,892 | A | * | 12/1954 | Campbell | 95/66 |
| 3,818,682 | A | * | 6/1974 | Farrow et al. | 96/25 |
| 4,078,503 | A | * | 3/1978 | von Dreusche, Jr. | 110/208 |
| 4,144,359 | A | | 3/1979 | Zahedi et al. | 427/474 |
| 4,306,885 | A | * | 12/1981 | Kober et al. | 95/60 |
| 4,308,036 | A | | 12/1981 | Zahedi et al. | 95/68 |
| 4,338,112 | A | | 7/1982 | Propster | 65/27 |
| 4,338,113 | A | | 7/1982 | Hohman et al. | 65/27 |
| 4,374,652 | A | | 2/1983 | Zahedi et al. | 95/69 |
| 4,505,723 | A | | 3/1985 | Zahedi et al. | 96/40 |
| 4,542,000 | A | | 9/1985 | Alexander et al. | 423/244.04 |
| 4,582,521 | A | | 4/1986 | Froberg | 65/27 |
| 4,668,489 | A | * | 5/1987 | Alexander et al. | 423/240 R |
| 4,675,029 | A | * | 6/1987 | Norman et al. | 95/73 |
| 4,813,978 | A | | 3/1989 | Hirth et al. | 95/60 |
| 5,282,885 | A | | 2/1994 | Cameron | 95/66 |
| 5,290,334 | A | | 3/1994 | Alexander | 65/335 |
| 5,342,427 | A | | 8/1994 | Alexander | 65/27 |
| 5,458,663 | A | * | 10/1995 | Teague et al. | 96/52 |
| 5,505,825 | A | | 4/1996 | Gold et al. | 95/126 |
| 5,556,443 | A | | 9/1996 | Alexander | 65/27 |
| 5,578,102 | A | | 11/1996 | Alexander | 65/27 |
| 5,665,142 | A | * | 9/1997 | Wright | 95/58 |
| 5,681,375 | A | * | 10/1997 | West et al. | 96/19 |
| 5,917,138 | A | | 6/1999 | Taylor | 96/61 |
| 5,922,290 | A | | 7/1999 | Jenne et al. | 422/173 |
| 5,980,610 | A | * | 11/1999 | Huang et al. | 95/58 |
| 6,251,170 | B1 | * | 6/2001 | Hironaka et al. | 96/28 |

FOREIGN PATENT DOCUMENTS

| | | | | |
|---|---|---|---|---|
| JP | 60-227844 | * | 11/1985 | 96/74 |

* cited by examiner

*Primary Examiner*—Richard L. Chiesa
(74) *Attorney, Agent, or Firm*—Miles & Stockbridge PC

(57) ABSTRACT

Pollutants in a flue gas stream from a dryer of products, such as wood chips, are removed by a pollution abatement system that includes an electrified filter bed unit for removing solid particulates. To prevent deteriorated operation of the electrified filter bed unit due to condensation of volatile organic compounds, the flue gas stream is heated, prior to admission to the electrified filter bed unit, to a temperature sufficient to convert condensable liquid aerosols to a gaseous state. The electrified filter bed unit then removes solid particulate selectively without collecting condensable organics. After the flue gas stream has passed through the electrified filter bed unit, gaseous pollutants can be removed by an oxidation process, for example.

10 Claims, 5 Drawing Sheets

EFB+RTO W/AIR TO AIR HEAT EXCHANGER

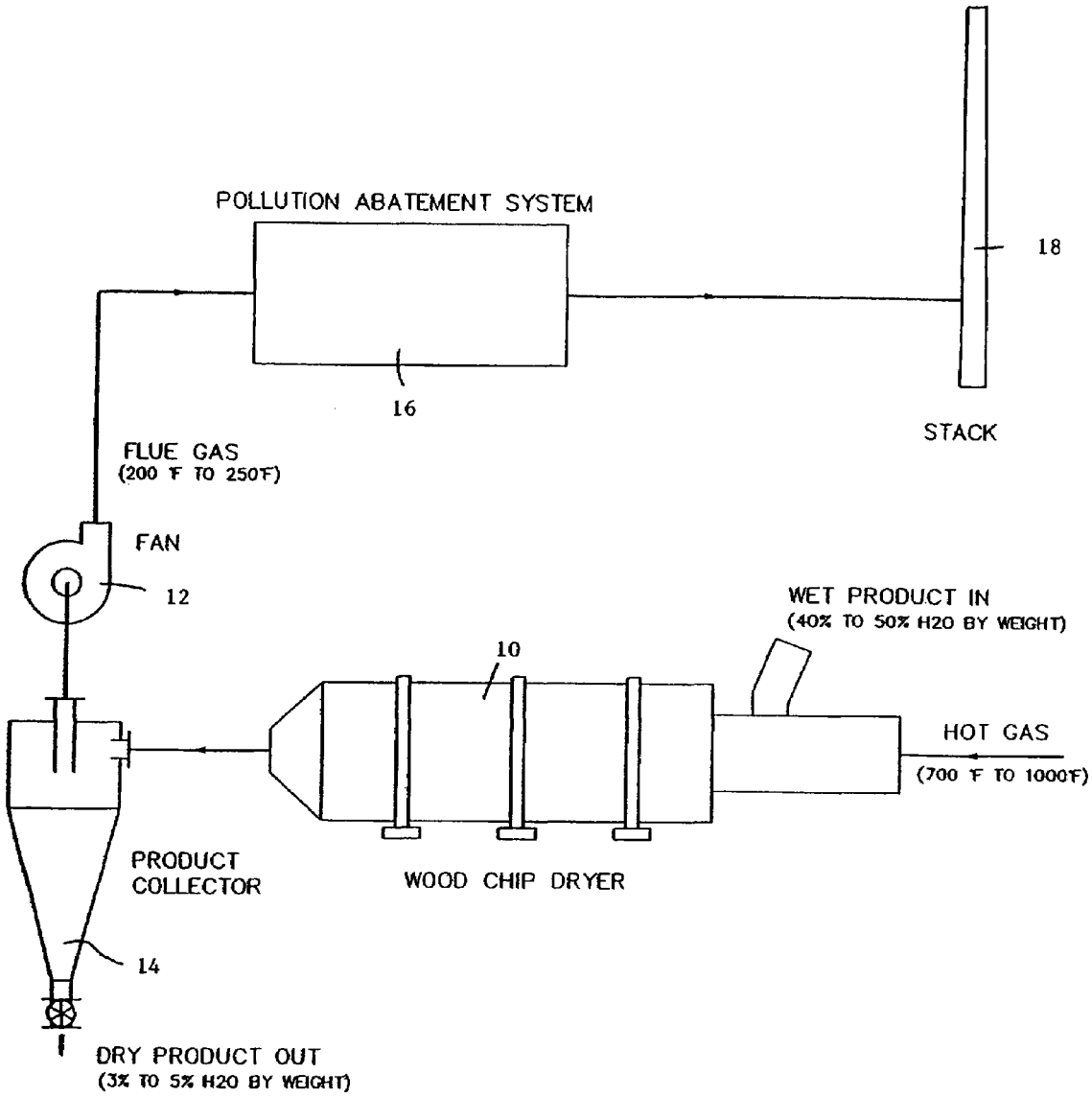
FIG. 1– TYPICAL WOOD CHIP DRYER ARRANGEMENT
PRIOR ART

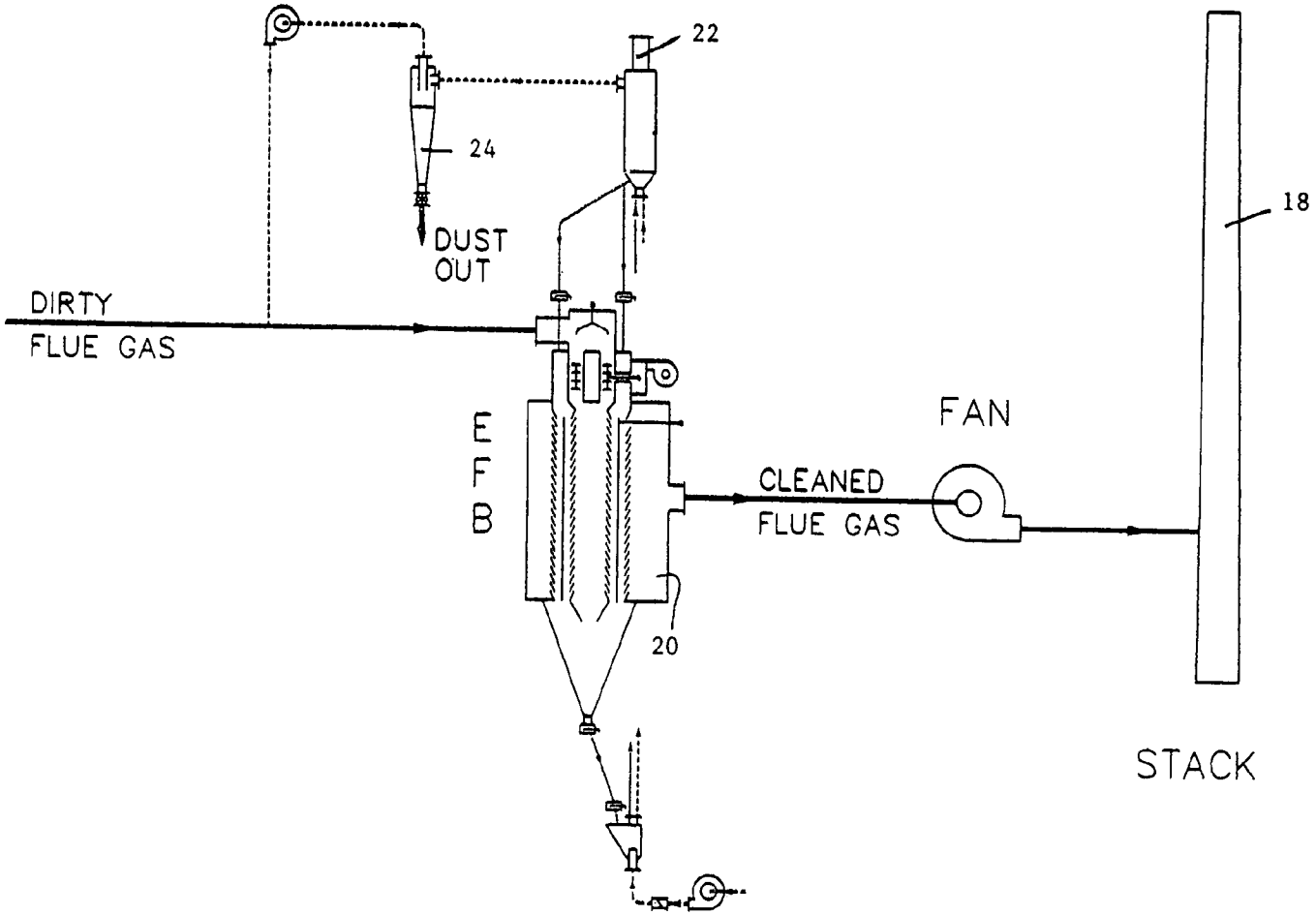
PRIOR ART
FIG. 2 – EFB OPERATION

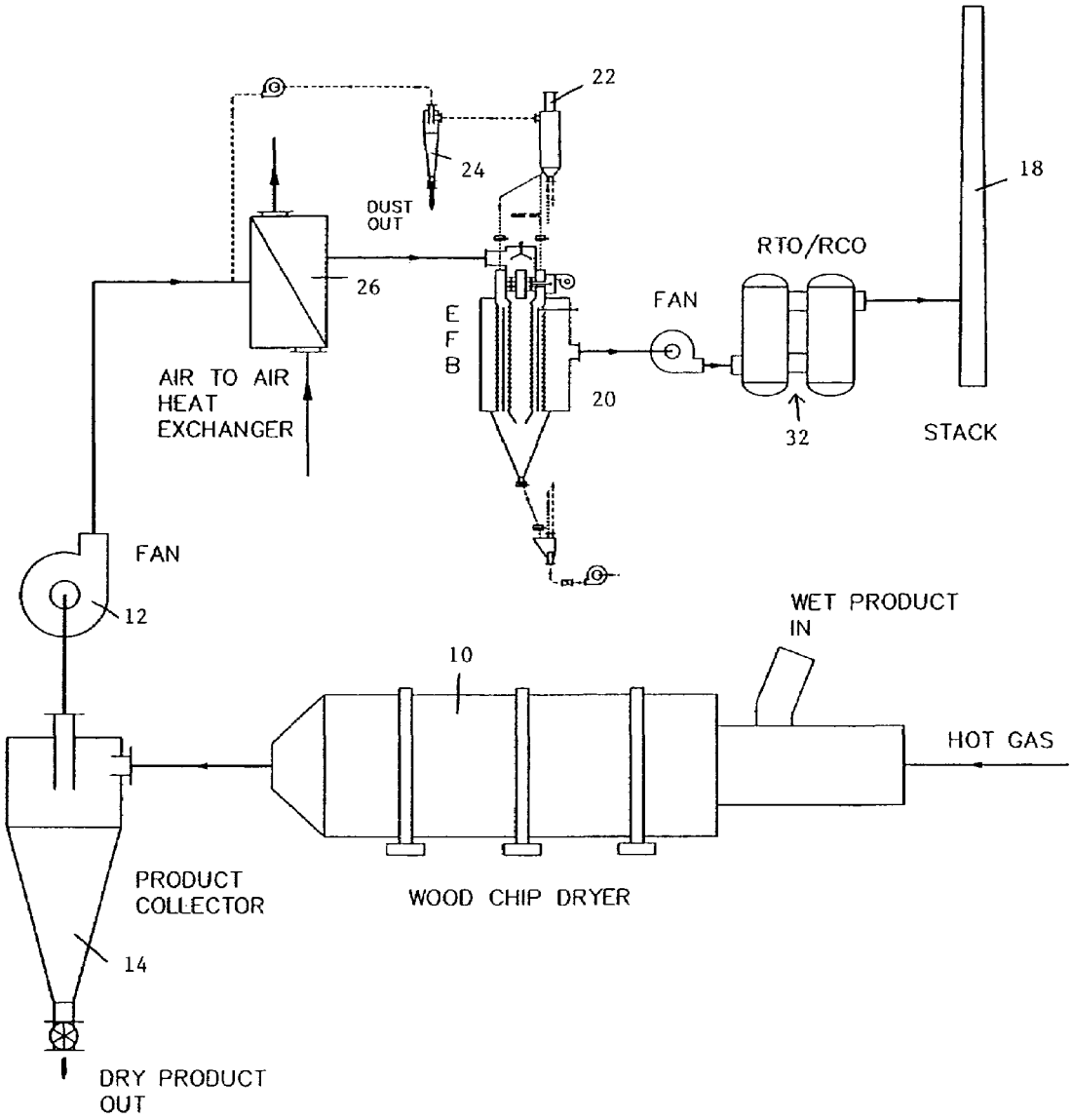
FIG. 3 EFB+RTO W/AIR TO AIR HEAT EXCHANGER

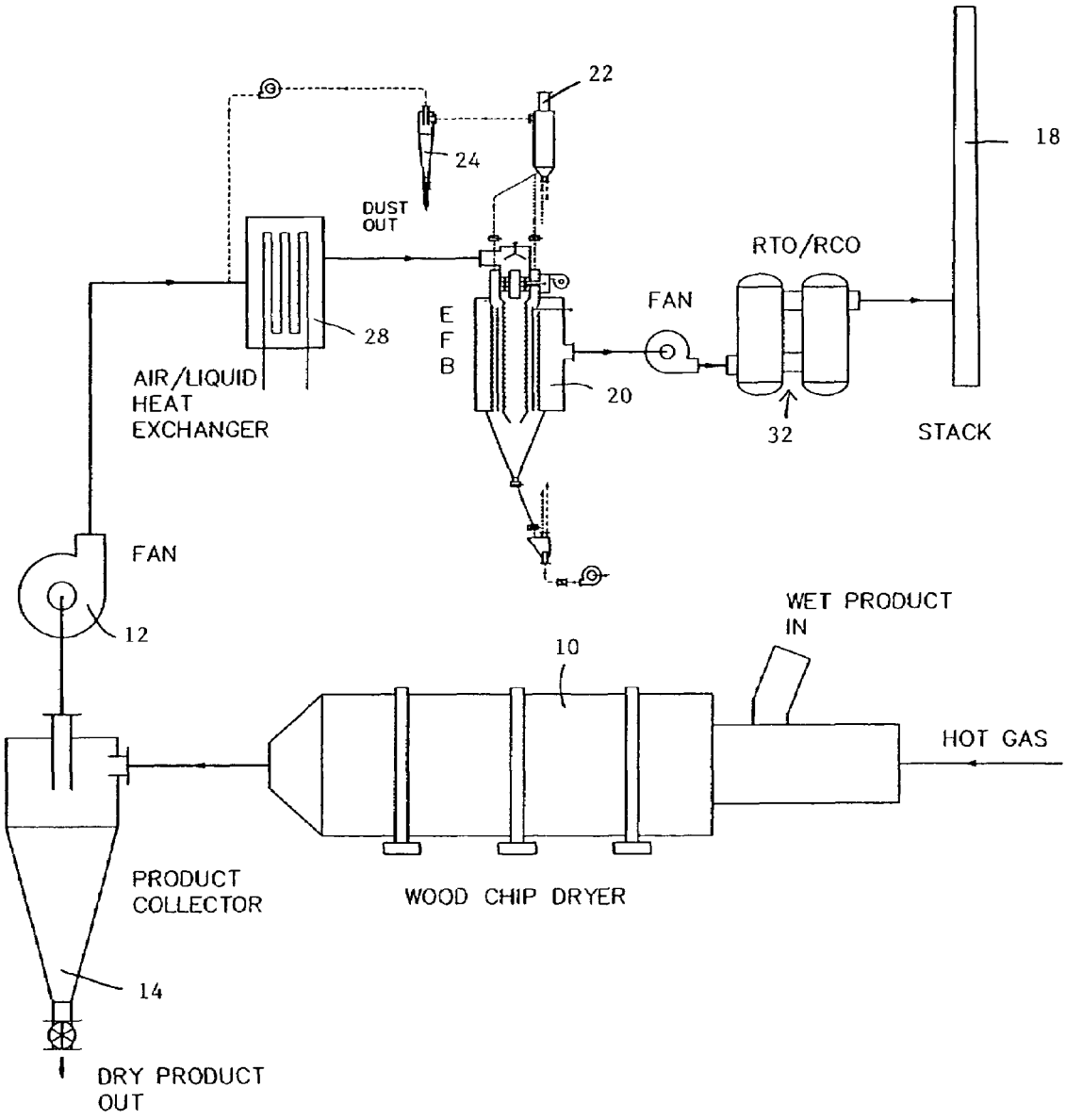
FIG. 4 EFB+RTO W/AIR/LIQUID HEAT EXCHANGER

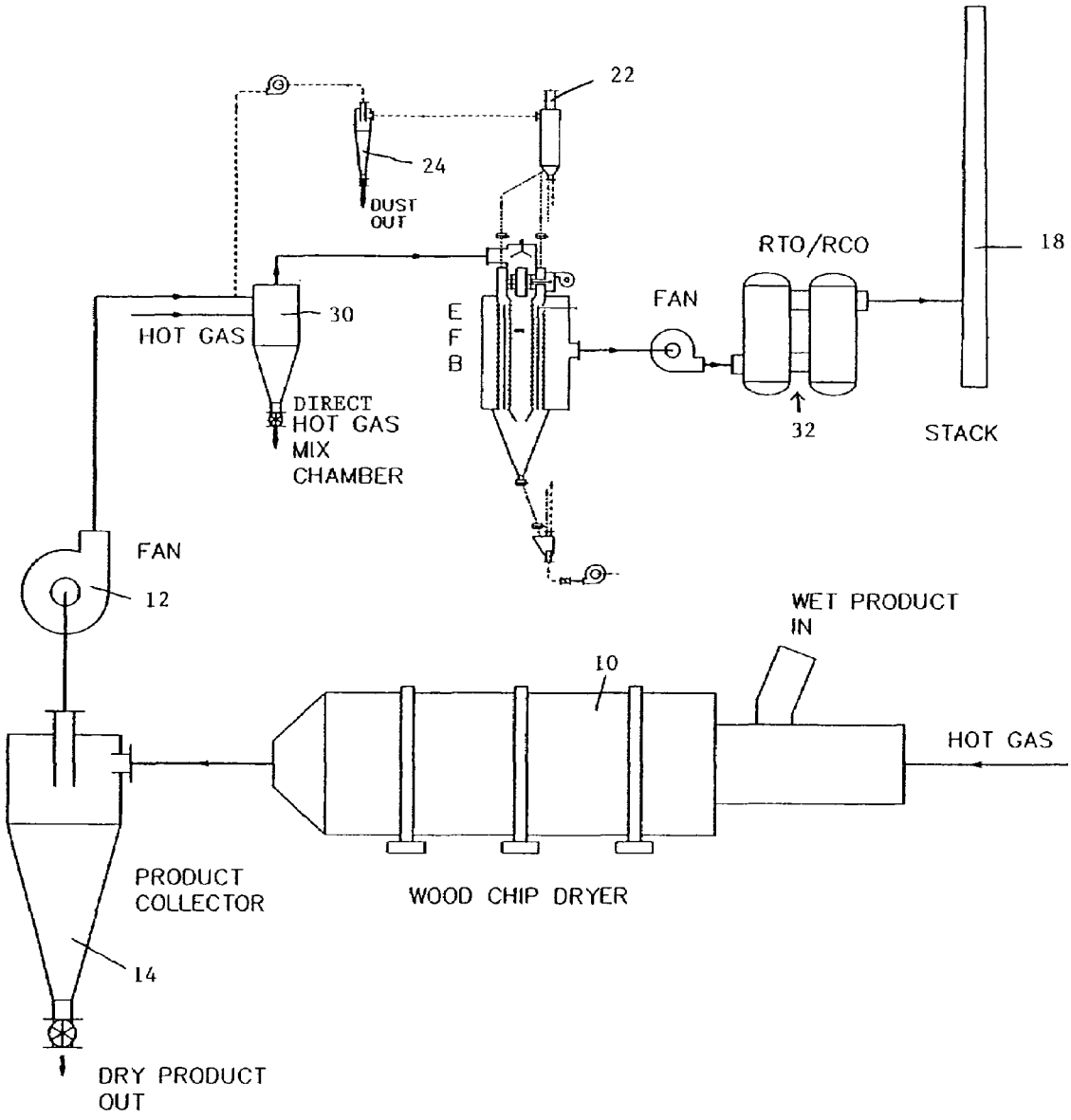
FIG. 5 EFB+RTO W/AIR TO AIR HEAT EXCHANGER

APPARATUS AND METHOD USING AN ELECTRIFIED FILTER BED FOR REMOVAL OF POLLUTANTS FROM A FLUE GAS STREAM

BACKGROUND OF THE INVENTION

This invention is concerned with the removal of pollutants from a flue gas stream, such as a gas stream resulting from a drying process for wood chips, for example. More particularly, the invention is concerned with ensuring effective operation of an electrified filter bed used to remove solid particulates from a gas stream containing condensable liquid aerosols.

In the production of wood panelboard (particleboard, waferboard, oriented strand board, chipboard, etc.) the raw feed product (which, for convenience, will be referred to herein, generically, as wood chips) must first be dried before being pressed with binders into boards. In most cases, the raw feed moisture content is in the range of 40% to 50% by weight and must be dried to a level of about 3% to 5%. This is accomplished by direct contact of the raw feed with hot flue gases in a rotating kiln, such as a dryer 10 shown in FIG. 1. Typically, the hot gases are generated by burning waste wood particles, such as bark, sawdust, or the like. The hot gas at the dryer inlet can be around 700° F. to 1000° F., while the exhaust from the dryer will usually range between 200° F. to 250° F. The dried product is carried out of the dryer with the flue gases, as by a fan 12, and is then collected in large cyclones 14. Dried wood chips are then coated with a binder and pressed into boards. The flue gases from the dryer exhaust must be cleaned by a pollution abatement system 16 prior to discharge into the atmosphere via a stack 18.

There are three major types of pollutants that are produced in the drying process. Ash from combustion of wood fuel results in fine fly ash in the flue gas. Wood fibers are present that are too fine and not collected by the cyclone. Both of these are dry dust particles. The third type of pollutants is Volatile Organic Compounds (VOC) such as terpenes, isoprenes, resins and fatty acids, that are driven off the wood chips during the drying process. Some of these organic pollutants condense into sticky liquid aerosols at the exhaust temperature of the dryers, while a majority of the organics remains in the gas phase.

The amount of the VOC emission depends on many factors. The most important one is the wood species being dried. Other factors are the drying temperature and the residence time of the wood chips in the hot zone of the dryer. Wood chips from trees such as poplar and aspen do not contain much organics and therefore do not generate much VOC emissions. However, trees such as southern and yellow pine have a large amount of organics that generate a lot of VOC emissions, both in a condensed form of aerosol and non-condensable gaseous forms. Typically, drying southern pine can produce 5 to 10 times VOC/ton of products as compared to drying poplar.

New EPA national standards for Hazardous Air pollution from composite board plants (40 CFR parts 63 and 429) require strict reduction of VOC emissions. Additionally each board plant is required to follow a rigorous permitting procedure know as Title V to establish the use of the Best Available Control Technology (BACT) for the control of its emissions. Such strict standards often require reduction of the particulate emissions to levels below 0.01 grains/ft$^3$ and 90% reduction of VOC emissions.

Electrified filter bed (EFB) technology developed by EFB, Inc. has been used for collection of particulates such as fly ash from wood fired boilers, etc. In an EFB unit, pollutant particles in a dirty flue gas stream enter the EFB unit and are given an electrostatic charge by means of a corona ionizer type device and are then deposited onto the surface of pea size gravel in a filter bed. An electrode in the filter bed polarizes the filter media and hence provides caps of positive and negative charges. The electrical force between the charged pollutant particles and the polarized filter media results in an effective attraction and capture of the pollutant particles on the filter media. The cleaned gas then exits the filter.

FIG. 2 details typical operation of an Electrified Filter Bed 20. The filter media coated with the pollutant is removed from the filter and cleaned externally by means of a pneumatic transport line. Filter media with the collected pollutant is conveyed pneumatically to the top of the system where it impacts onto a bounce pad 22. The relatively heavier filter media return to the filter for further use, while the light dust particles are carried out with the transport air and are collected in a small collector 24 such as a bag filter or a super efficient cyclone.

For further details of EFB technology, see, for example, U.S. Pat. No. 4,144,359 granted Mar. 13, 1979; U.S. Pat. No. 4,308,036 granted Dec. 29, 1981; U.S. Pat. No. 4,374,652 granted Feb. 22, 1983; U.S. Pat. No. 4,505,723 granted Mar. 19, 1985; and U.S. Pat. No. 4,542,000 granted Sep. 17, 1985, all assigned to EFB, Inc.

Since 1987, EFB units of this type have been installed for the removal of particulates from wood chip dryers. These installations have been in plants that use wood species such as aspen and poplar, normally in the northern states and Canada. As discussed earlier, the organic emission from drying such wood species is minimal. Although the EFB reduces particulate emissions in these plants, VOC emission is not effectively reduced by the EFB, and further abatement devices like a RTO type system are required.

EFB technology has not been used successfully with dryers for wood species such as southern and yellow pine, mostly located in the southern states. In such applications, a problem has been discovered, namely, that once the EFB collects some of the condensable hydrocarbons as well as the dry dust particles, the liquid hydrocarbons act as an adhesive and quickly make the filter media (gravel) become sticky and stop flowing normally. This problem intensifies as more and more southern pine, for example, is processed.

Normally, the gas temperature at the exhaust of the wood chip dryer is in the range of 200° F. to 250° F. Lower gas temperatures result in further condensation of organic pollutants into liquid aerosols and increase coating of the filter media. These aerosols form a sticky coating on the gravel of the EFB and rapidly prevent the gravel from flowing freely through the EFB filter. This leads to plugging of the EFB and rapid rise in the pressure drop across the EFB filter. The EFB must then be placed off line. During late 1980's, EFB, Inc. installed a few units for this type of application, but the units did not work, and eventually they were removed and other abatement systems, such as wet electrostatic precipitators, were installed.

During the mid 1990's in the US, total removal of VOC and formaldehyde became a requirement by the EPA for the board plants, as well as removal of particulates. EPA considered the process of incineration as the most viable means to control VOC, and forced most plants to install such equipment. In the incineration process, the destruction of gaseous pollutants or VOC is achieved by heating the gas stream to a temperature of between 1200° F. to 1800° F., where the VOC spontaneously oxidizes into carbon dioxide and water. RTO (Regenerative Thermal Oxidizer) and RCO (Regenerative Catalytic Oxidizer) are two technologies that utilize the incineration principle to destroy the VOC emissions and have been widely viewed as processes of choice for these applications.

RTO and RCO units incinerate fumes and use heat recovery to reduce the energy cost associated with heating gases to high temperatures. The capability of an RTO, for example, to control VOC emissions is hampered by the presence of solid and alkali particles in the gas stream. The gas flow through the packing media in the RTO is diminished as the solid particles drop out in the void area of the bed and plug up the heat transfer media. Also, the presence of alkali particles attacks the RTO media chemically and breaks it down. Both of these effects will result in the pluggage of the RTO media. Therefore, solid particles must be effectively removed from the gas stream prior to treatment in the RTO units.

At the present time, wet scrubbers and wet electrostatic precipitators have mostly been used as control equipment ahead of the RTO systems. EFB units in their present form will not work for the control of particulates ahead of RTO for dryer applications with wood species having high organic content. The use of wet electrostatic precipitator (ESP) systems ahead of the RTO has become the standard for almost all the board plants in the US. However, wet ESP systems have the following major problems:

1: The use of water for continuous washing of the collecting electrodes as well as quenching the gas stream creates large quantities of waste water discharge and water pollution issues.

2: The wet ESP systems cause sever corrosion problems for the equipment downstream.

3: To combat corrosion, equipment must be made from high grade stainless steel, which is expensive.

4: Quenching the flue gas and then reheating it via the RTO is not energy efficient.

Therefore, it is very desirable to be able to utilize a dry type system such as an EFB, instead of a wet system ahead of the RTO units. Such an approach will alleviate all the problems listed above. Most importantly, it will avoid pollution control issues related to waste water discharge.

BRIEF DESCRIPTION OF THE INVENTION

The present invention provides an improved apparatus and method for abatement of pollutants in a flue gas stream by the use of an electrified filter bed. In accordance with the invention, a heater raises the temperature of flue gas ahead of an electrified filter bed to a level sufficient to render liquid aerosols gaseous, and to prevent condensation in the bed of liquid aerosols in the flue gas. The electrified filter bed removes solid particulate without collecting liquid aerosols. Gaseous state aerosols can be removed downstream of the electrified filter bed by incineration, for example.

BRIEF DESCRIPTION OF THE DRAWINGS

The invention will be further described in conjunction with the accompanying drawings, which illustrate preferred (best mode) embodiments, and wherein:

FIG. 1 shows a typical wood chip dryer arrangement with a pollution abatement system;

FIG. 2 shows a typical electrified filter bed operation;

FIG. 3 shows an apparatus of the invention according to a first embodiment;

FIG. 4 shows an apparatus of the invention according to a second embodiment; and FIG. 5 shows an apparatus of the invention according to a third embodiment.

DETAILED DESCRIPTION OF THE INVENTION

In a wood chip dryer arrangement, such as that shown in FIG. 1, for example, an EFB unit is used as part of a pollution abatement system.

To prevent gravel in the EFB unit from becoming sticky, the invention uses a reheating step ahead of the EFB to boost the gases to a high enough temperature to re-evaporate organics into a gaseous state as well as preventing condensation of some organics without affecting solid particles. The flue gas reheat can be accomplished, for example (without limitation), by utilizing a heat exchanger, such as an air-to-air heat exchanger 26 shown in FIG. 3, or an air/liquid indirect heat exchanger 28 shown in FIG. 4, or by directly mixing the flue gases with another hot gas stream in a direct hot gas mix chamber 30, as shown in FIG. 5. In all of these embodiments, the flue gas containing solid particles (fly ash and wood fines) and VOCs is heated to a temperature such that only solid particulates are present in the gas stream, with all the other organics present in the gaseous phase.

For wood chip dryers with the typical exhaust temperature of about 200° F. to 250° F., a portion of the organics is present in the form of liquid condensed aerosols, with the rest of the VOC being present in the gaseous phase. If the flue gas is then heated by 50° F. to 100° F., a major portion of the liquid aerosols will go back to the gas phase and will not then be present in the liquid form. Once the organics have turned into the gaseous phase, they are not filtered by the EFB, and they pass through the EFB uncollected. However, solid particulates are still filtered by the EFB. Therefore, addition of a device to reheat the flue gas as described above, such as a heat exchanger, enables the EFB to operate effectively to remove solid particulates without collecting the organic liquid aerosols. Once the gaseous organics are passed through the EFB, they can then be treated by an incineration device, such as an RTO or RCO unit 32, where the VOCs are oxidized and destroyed, and clean air is then discharged to the atmosphere.

In summary, the invention enables the operation of an EFB unit to selectively filter solid particulates without collecting condensable organics.

While preferred embodiments of the invention have been shown and described, it will be apparent that changes can be made without departing from the principles and spirit of the invention, the scope of which is defined in the following claims.

What is claimed is:

1. Apparatus for drying particulate material and controlling emission of pollutants in flue gas, comprising a dryer using a hot gas stream, a pollution abatement system, and means for passing the flue gas through said pollution abatement system, wherein the flue gas contains particulate pollutants, gaseous pollutants, and condensable liquid aerosols, and wherein the pollution abatement system includes an electrified filter bed unit, and a heater, the flue gas being passed from the dryer through the heater and the electrified filter bed unit in that order, wherein the heater raises the temperature of the flue gas passed therethrough to a level sufficient to render liquid aerosols gaseous and to prevent condensation of the aerosols in the electrified filter bed unit, and the electrified filter bed unit removes particulates from the flue gas passed therethrough, without removing gaseous pollutants.

2. Apparatus according to claim 1, further comprising an incineration unit that receives flue gas passed from the electrified filter bed unit and that oxidizes gaseous pollutants in the flue gas.

3. Apparatus according to claim 1, wherein the heater is an air-to-air heat exchanger.

4. Apparatus according to claim 1, wherein the heater is an air/liquid heat exchanger.

5. Apparatus according to claim 1, wherein the heater is a direct hot gas mixing chamber.

6. A method of removing pollutants in a flue gas stream from a dryer of particulate materials, wherein the flue gas stream contains solid particulate pollutants, gaseous pollutants, and condensable liquid aerosol pollutants, said method comprising:

passing the flue gas stream through an electrified filter bed unit to remove the solid particulate pollutants from the flue gas stream; and prior to passing the flue gas stream through the electrified filter bed unit, heating the flue gas stream to a temperature sufficient to convert the condensable liquid aerosol pollutants to a gaseous phase and to maintain that phase as the flue gas stream is passed through the electrified filter bed unit, so that operation of the electrified filter bed unit is not impaired by condensation of the liquid aerosol pollutants in the electrified filter bed.

7. A method according to claim 6, wherein the flue gas stream is passed from the electrified filter bed unit to an incinerator to destroy gaseous pollutants.

8. A method according to claim 6, wherein the material dried comprises wood chips and the pollutants in the flue gas stream include volatile organic compounds that are driven off of the wood chips during the drying.

9. A method according to claim 8, wherein the wood chips are from southern and/or yellow pine.

10. A method according to claim 6, wherein the drying is performed in a dryer using hot gas supplied to the dryer in a temperature range of about 700° F. to 1000° F., the flue gas stream is emitted from the dryer at a temperature range of about 200° F. to 250° F., and prior to passing the flue gas stream through the electrified filter bed unit, the temperature of the flue gas stream is raised by about 50° F. to 100° F.

* * * * *